United States Patent [19]

Wernz

[11] Patent Number: 4,883,675

[45] Date of Patent: Nov. 28, 1989

[54] FLEXIBLE PACKAGE HAVING MAIN COMPARTMENT AND ANCILLARY COMPARTMENT

[75] Inventor: Donna M. Wernz, Cincinnati, Ohio

[73] Assignee: The Procter & Gamble Company, Cincinnati, Ohio

[21] Appl. No.: 277,750

[22] Filed: Nov. 30, 1988

[51] Int. Cl.[4] ..... B65D 30/22; B65D 85/62

[52] U.S. Cl. ..... 426/120; 206/568; 206/610; 383/2; 383/38; 383/40; 383/41

[58] Field of Search ..... 426/120, 124; 206/568, 206/610; 383/38, 40, 41, 2

[56] References Cited

U.S. PATENT DOCUMENTS

| | | | |
|---|---|---|---|
| 1,889,882 | 12/1932 | Woods | 426/120 |
| 1,983,418 | 12/1934 | Thurmer | 383/38 |
| 2,006,696 | 7/1935 | Koeble | 229/27 |
| 2,083,860 | 6/1937 | Offenbacher | 229/56 |
| 2,212,390 | 8/1940 | Conklin | 383/2 |
| 2,298,545 | 10/1942 | Waters | 426/108 |
| 2,361,852 | 10/1944 | Locke, Jr. | 206/16 |
| 2,828,858 | 4/1958 | Tooke | 383/38 |
| 2,841,276 | 7/1958 | Schwimmer et al. | 206/57 |
| 3,144,931 | 8/1964 | Long | 383/38 |
| 3,224,640 | 12/1965 | Schneider et al. | 222/107 |
| 3,323,640 | 6/1967 | Kugler | 206/47 |
| 3,429,718 | 2/1969 | Helms | 99/171 |
| 3,469,768 | 9/1969 | Repko | 229/56 |
| 3,664,569 | 5/1972 | Dock | 229/10 |
| 3,731,870 | 5/1973 | Buttery | 229/27 |
| 3,756,389 | 9/1973 | Firth | 206/47 A |
| 3,838,758 | 10/1974 | Brown | 383/2 |
| 3,915,295 | 10/1975 | Morrison | 206/91 |
| 3,954,220 | 5/1976 | Foster | 229/27 |
| 4,101,034 | 7/1978 | Yamaguchi | 206/612 |
| 4,542,826 | 9/1985 | Adams | 383/38 |
| 4,786,189 | 11/1988 | Broderick et al. | 383/75 |
| 4,786,190 | 11/1988 | Van Erden et al. | 383/61 |
| 4,786,191 | 11/1988 | Broderick et al. | 383/75 |
| 4,819,793 | 4/1989 | Willard et al. | 383/38 |

*Primary Examiner*—Stephen P. Garbe

*Attorney, Agent, or Firm*—R. C. Witte; E. K. Linman; M. E. Hilton

[57] ABSTRACT

A package made of a single rectangular sheet of flexible material which has both a main product compartment and an ancillary compartment. The main compartment is filled with product stacked in columns separated by a grid of cardboard or similar material and thereafter sealed. The main compartment also has a tear strip for providing a dispensing opening in the side of the compartment for removing the product units one at a time from the columns. The ancillary compartment being made of flexible material can be folded down and secured in a collapsed position so that the package can be shipped without adding additional shipping volume. The ancillary compartment is also open at its axial end to allow the insertion and removal of ancillary materials in route to the end user. Means, such as a drawstring, are provided to repeatedly open and close the ancillary compartment without damaging the package.

12 Claims, 2 Drawing Sheets

FLEXIBLE PACKAGE HAVING MAIN COMPARTMENT AND ANCILLARY COMPARTMENT

TECHNICAL FIELD

This invention relates to a flexible package and, more particularly, to a package having a sealed main compartment with a dispensing opening and a collapsible ancillary compartment which has a separate opening which can be repeatedly opened and closed.

BACKGROUND OF THE INVENTION

Presently some coffees intended for commercial consumption are shipped to a distributor in partially empty cardboard cartons. Upon receipt, the distributor opens these partially empty cartons and inserts ancillary materials, e.g., cups, filters, creamer, stirrers and sweeteners. Then the distributor reseals the cartons and transports them for sale to the end user; in this case, coffee providing establishments. The end user then opens the package to remove coffee and ancillary materials as needed.

This system results in increased shipping volume and produces a corresponding increase in shipping costs. Thus, it is desirable to ship these products in packages which have a volume substantially equal to the volume of the product itself during shipment from the product manufacturer. It is also desirable to enable a subsequent increase in package volume to permit the insertion of ancillary materials. Furthermore, it is desirable to provide a means for orderly incremental dispensing of the package contents. It is additionally desirable to provide the above features while reducing packaging and shipping costs to a minimum.

In addition to coffee, there are other products which could benefit from being shipped in a package which includes an ancillary compartment requiring only a slight increase in shipping volume. Diapers, for instance, could be beneficially packaged in such a container. The package used to ship the diapers would double as a diaper bag by allowing the consumer to simply fill the ancillary compartment with items such as baby powder, baby wipes, extra clothes, etc.

Schwimmer et. al., U.S. Pat. No. 2,841,176 and Dock, U.S. Pat. No. 3,664,569, disclose cardboard packages having collapsible ancillary areas. Morrison, U.S. Pat. No. 3,915,295, discloses a hard or soft cigarette pack with a slidable drawer for accommodating matches. None of these references teach a flexible bag having a reclosable and securable ancillary compartment with a dispensing opening in the main compartment.

Schneider et al., U.S. Pat. No. 3,224,640, Kugler, U.S. Pat. No. 3,323,640, Helms, U.S. Pat. No. 3,429,718 and Repko, U.S. Pat. No. 3,469,768 disclose flexible multi-compartment packages. These references, however, do not teach accessing each compartment through separate opening means, nor do they teach the securely reclosable feature.

Although the prior art discloses examples of packages having collapsible ancillary compartments, none of these references teach a package made of flexible material having two vertically adjacent compartments; one with a means for permanently opening the compartment for dispensing and one with a securely reclosable opening means.

OBJECTS OF THE INVENTION

An object of the invention is to provide a dispensing package which has an ancillary compartment which can be collapsed so it does not increase the overall shipping volume.

It is likewise an object of the invention to provide a dispensing package which has an ancillary compartment which can be filled either in route to, or by the end user.

It is also an object of the invention to provide a shipping package with a main compartment which is sealed but which also has a means for creating an opening to allow orderly dispensing of the package contents.

Another object of the invention is to provide a shipping package having an ancillary compartment which can be repeatedly opened and closed without damaging the package.

Additionally, it is an object of the invention to provide a package which facilitates handling operations throughout the package's life.

It is further an object of the invention to accomplish the aforementioned objectives while reducing packaging and shipping costs to a minimum.

Other objects will become apparent hereinafter.

DISCLOSURE OF THE INVENTION

In accordance with one aspect of the present invention there is provided a flexible package which includes a main compartment and a vertically extended ancillary compartment. The main compartment totally encloses a column of stacked product units adjacent to the side wall and is sealed. A line of weakness is provided in the main compartment for creating an opening within the side wall for removing said product one at a time without other product protruding from the package. The ancillary compartment is open at its uppermost axial end to allow the insertion and removal of ancillary materials. This ancillary compartment is fitted with means to allow repeated opening and closing operations without damaging the package.

BRIEF DESCRIPTION OF THE DRAWINGS

While the specification concludes with claims which particularly point out and distinctly claim the subject matter forming the present invention, it is believed that the invention will be better understood from the following description of the preferred embodiment taken in conjunction with the accompanying drawings in which:

DESCRIPTION OF THE PREFERRED EMBODIMENT

Figure 3:
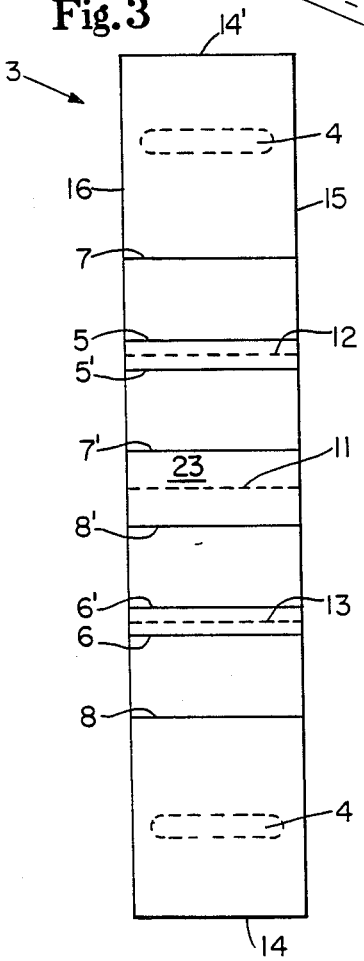
FIG. 3 is a plan view of the rectangular sheet of flexible material used to make the package of FIGS. 1 and 2.

The present invention comprises a multi-compartmented package with both main 1 and ancillary 2 compartments. The package manufacturer forms the package from a flexible sheet of polyethylene or other suitable flexible material, e.g. polyethylene, cellophane, saran, foil, or a flexible laminate. The flexible material is preferably cut into a rectangular blank 3 as generally shown in FIG. 3, which results in reduced waste and costs. Costs are further reduced since utilizing a single sheet eliminates the need for registering several sheets of material together which requires additional time and machinery.

Figure 7:
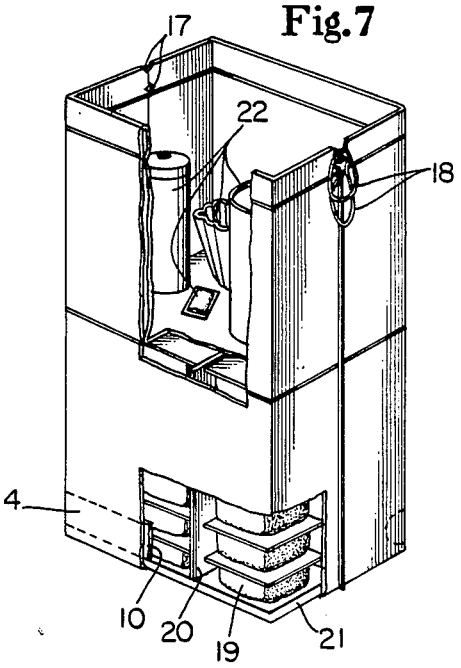
FIG. 7 is a front elevational cut-away view of the package of FIGS. 1 and 2 showing the individual product packages separated by the vertical cardboard grid, said individual product units being stacked on the platform within the main compartment, and the ancillary compartment being filled with ancillary materials.

Two tear strips 4 are perforated into the rectangular blank 3 as shown in FIG. 3. Next, a cardboard 10 or similar backing is laminated to the tear strip 4 as shown in FIG. 7 to aid its removal. For clarity, the parameters of the tear strip 4 will be discussed after its use has been developed hereinafter.

The perforated rectangular blank 3 is then folded along the transverse fold line 11 to determine the midpoint and folded back along transverse fold lines 12 and 13. Thus, the transverse seal lines 5, 6, 7 and 8 are aligned with corresponding transverse seal lines 5', 6', 7', and 8' respectively and glued, heat sealed, or otherwise joined along these lines resulting in the modified "M" shape evidenced in the sectional view of FIG. 5. Maintaining the alignment of transverse seal lines 5 with 6, 7 with 8, and one transverse edge 14 of the blank with the other transverse edge 14' each axial edge of the blank 15 and 16 is sealed to itself, creating a double walled ancillary compartment 2 and a single walled main compartment 1.

Sealing transverse lines 5 with 5' and 6 with 6' creates two casings which in combination circumscribe the opening in the top axial end of the shell. Preferably two "V" shaped notches 17 are cut in the casing area at each of the side seams through which two drawstrings 18 are threaded. Threading each drawstring 18 through a different pair of notches 17 enables easier grasping and closing operations. Thus, the shell corresponding to that shown in FIG. 4 and shown in cross-section in FIG. 5 is manufactured. If the package manufacturer is not also the product manufacturer this shell is then shipped to the product manufacturer in collapsed form reducing shipping volume and therefore package costs.

The product manufacturer prepares the product units 19 for insertion into the package shell. The units of product 19 are stacked in columns. To facilitate stacking and provide stability the product units 19 have preferably some portion of their upper and lower surfaces planar, although they can have virtually any shape. In some cases, as with coffee, it is desirable to individually wrap units of product 19 to provide these planar surfaces. Thus, the product unit 19 of the preferred embodiment is a coffee containing relatively hard rectangular cube having a flanged top and a planar closure affixed thereto and is disclosed fully in U.S. Pat. No. 4,684,025 incorporated herein by reference.

After stacking, six columns of product are arranged in a two by three configuration. This configuration is preferred for use with product units 19 having relatively square horizontal cross sectional areas because this two by three configuration results in each column being adjacent an exterior wall without creating a long, thin, unstable package. The product units of the preferred embodiment are approximately 75.5 mm long, 75 mm wide, 33 mm high and weigh approximately between 25 grams and 60 grams each.

Figure 6:
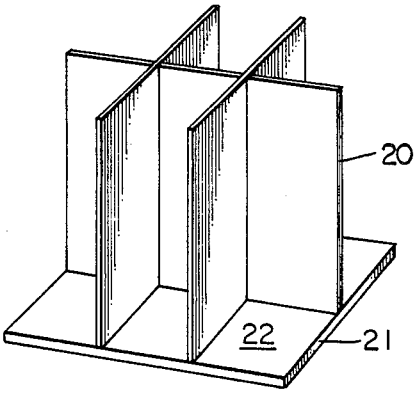
FIG. 6 is a perspective view of the vertical cardboard grid used to separate the columns and the horizontal platform used to support the product columns in the preferred package embodiment shown in FIGS. 1 and 2.

A vertical grid 20 made of sheets of cardboard or similarly rigid material as shown in FIG. 6 separates the columns and performs several valuable functions. First, the grid 20 provides continued support for the ancillary or unsealed compartment 2 and maintains the shape of the main or sealed compartment 1 after product units 19 are removed. Second, the grid 20 adds stability to the columns, particularly if unstable columns result from non-planar product units when product is removed from adjacent columns. Additionally, this grid 20 aids in allowing the relative motion of one column to another as product units 19 are removed. This is particularly important where the product units 19, as shown in the preferred embodiment, have protrusions which extend and can catch on the units of adjacent columns. To perform this function well the grid 20 should have relatively smooth planar surfaces. The necessary rigidity of the grid 20 is determined by several factors including the weight of the ancillary materials 22, the weight of the product units 19 and the order of product unit removal.

If the product manufacturer does not also manufacture the grid 20 it becomes important to control its shipping volume when shipped to the product manufacturer. Thus, it is preferable to make the grid 20 such that it can be either assembled by the product manufacturer or collapsed for shipment. The preferred embodiment illustrates a grid 20 made from three separate panels of cardboard material which are connected by slots extending half way through the height as is commonly seen. The slots of the central panel extend halfway down from the top and the slots of the other two panels extend halfway up from the bottom. Thus, the grid 20 is shipped in three pieces, conserving shipping volume, and can be assembled at the product packaging location.

The product columns and the separating grid 20 are preferably placed upon a horizontal platform 21 also made of cardboard or similar material. The rigidity and structure of this material is determined in part by the product unit removal characteristics and the combined weight of the product units 19 and ancillary materials 22. The platform 21 adds strength and rigidity to the package bottom and helps define the horizontal cross-sectional shape of the package. Also, the platform 21 raises the product columns so the opening can extend slightly below the bottom of the product unit being removed so product removal is not hindered by catching the flexible material at the bottom edge of the opening.

The dispensing opening, provided in the front and back sides of the main compartment 1 to allow access to each column, is formed by removing the tear strips 4 created by perforating or otherwise creating a line of weakness in the flexible material prior to its being folded and sealed. Cardboard backing strips 10 are preferably laminated to the tear strips 4 to aid their removal.

Figure 1:
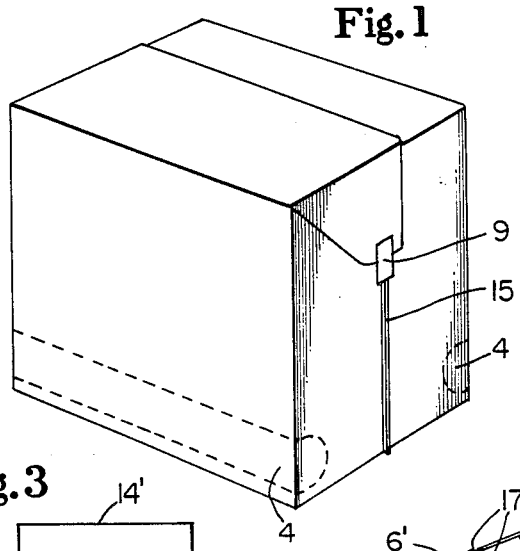
FIG. 1 is a perspective view of a preferred flexible package of the present invention filled with product and ready for shipment with its ancillary compartment collapsed.
Figure 2:
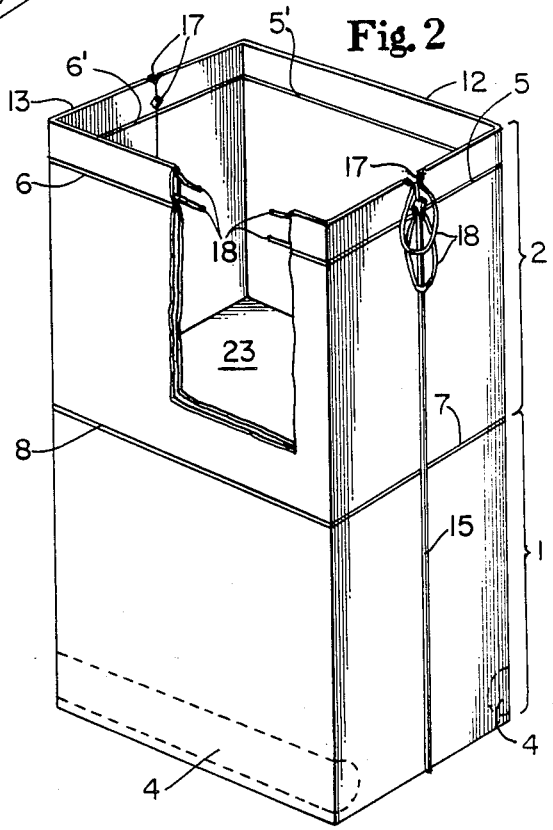
FIG. 2 is a partially cut-away perspective view of the flexible package of FIG. 1 with its ancillary compartment in its most expanded position.

The tear strips 4 are located near the bottom of the compartment and extend down to slightly expose the platform. Vertically, the opening created by the tear strip 4 removal extends up a distance of, preferably less than two times, and even more preferably less than one and one-half times the height of a product unit 19 from the bottom of the product unit to be removed; in this embodiment the product unit 19 resting on the platform surface 22. Thus the product unit 19 above the particular unit being removed is retained by the flexible material of the package wall at the top edge of the opening so it does not protrude from the package. Horizontally, the opening extends preferably slightly longer than the full length of the package side to wrap around onto the adjacent sides as shown in FIGS. 1 and 2. This distance is optimal because there is no flexible material at the corners to hinder the removal of product units 19 and is particularly important where the product units 19 are relatively rigid.

Figure 4:
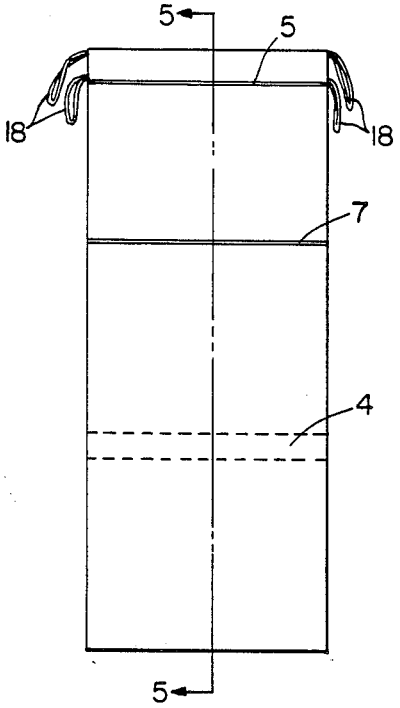
FIG. 4 is a front elevational view of the package of FIGS. 1 and 2 before the main compartment is sealed.
Figure 5:
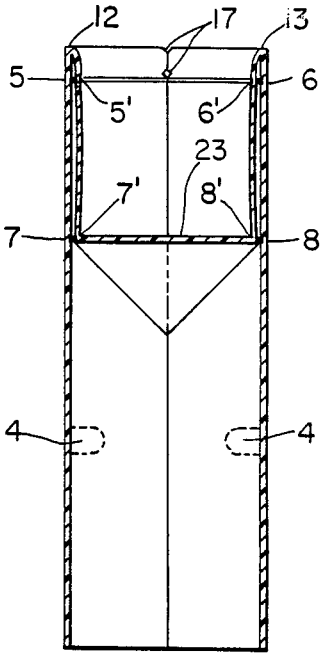
FIG. 5 is a sectional view taken along section line 5—5 in FIG. 4 showing how the flexible material is folded to make the package.

Once the product units 19 are stacked, placed on the platform 21 and separated by the grid 20, the main compartment 1 is opened and the shell of FIGS. 4 and 5 is brought around the product columns. The flexible material at the bottom axial end of the shell is folded much like wrapping paper and the main compartment 1 is sealed containing the product units 19. The manufacturer also insures that the ancillary compartment 2 is collapsed. This is done by folding the ancillary compartment 2 down and retaining it in its collapsed position. One method for retaining the ancillary compartment 2 in this position is to use tape 9, as shown in FIG. 1, which can be removed without damaging the flexible material.

The manufacturer of the product then ships the flexible package with its ancillary compartment 2 collapsed, as FIG. 1 illustrates, to his consumer thereby saving shipping volume and costs. In the coffee instance, the consumer would be a coffee distributor. The distributor would most likely resell and transport the package without alteration to an operator, again saving shipping costs. The operator would remove the tape 9 and expand the ancillary compartment 2 to the position shown in FIG. 2. Having done this, he would then fill this compartment 2 with any necessary ancillary materials 22, including sweetener, creamer, stirrers, cups and filters. The distributor pulls one drawstring to the right and one drawstring to the left to easily close the opening in the ancillary compartment 2. In addition, the drawstrings 18 can be tied together to insure the ancillary compartment 2 is securely closed and will not accidentally open to spill its contents. The drawstrings 18 also serve as a means to grasp the flexible package to ease carrying and handling operations. The distributor would then transport them to his consumer, the end user.

The end user in this case, most typically the preparer of office coffee, receives the package filled with both product units 19 and ancillary materials 22. He then unties the drawstrings 18, and opens the ancillary compartment 2 to remove any ancillary materials necessary to make a pot of coffee. He would also remove at least one tear strip 4 to create a dispensing opening in the main compartment 1 and remove a product unit 19 of coffee. He could then reclose and tie the ancillary compartment 2 using the drawstrings 18. Thus, the end user is provided with everything necessary to enjoy the manufacturer's product, in this case a fresh pot of coffee.

It is, of course, to be understood, that the present invention is, by no means, limited to the particular arrangement shown in the drawings, but also comprises any modifications within the scope of the appended claims.

What I claim is:

1. A flexible package having a sealed main compartment and an openable compartment for ancillary materials, said package comprising:

(a) a main compartment having a top wall and a bottom wall interconnected to one another by a multiplicity of side walls;

(b) an ancillary compartment vertically extended from said main compartment; and (c) a column of product units totally enclosed and sealed within said main compartment and adjacent at least one of said side walls; and (d) a continuous line of weakness for creating a dispensing opening within at least one of said main compartment side walls for removing said product units one at a time without other product units protruding from said flexible package; and (e) an opening at the top axial end of said ancillary compartment for inserting and removing ancillary materials; and (f) means for repeatedly opening and closing said ancillary compartment opening without damaging said flexible package.

2. A flexible package comprising:

(a) a single substantially rectangular sheet of flexible material folded and joined to form a main compartment having a top wall and a bottom wall interconnected to one another by a multiplicity of side walls, said main compartment exhibiting a polygonal cross-section in both the vertical and horizontal directions; and (b) columns of product units totally enclosed and sealed within said main compartment and adjacent at least on of said side walls; and (c) a grid formed from vertically disposed, substantially planar panels separating said product columns within said main compartment; and (d) a tear strip in at least one of said side walls of said main compartment of said flexible package; and (e) an ancillary compartment vertically adjacent said main compartment and open at its top axial end; and (f) a means for repeatedly opening and closing said ancillary compartment opening without damaging said flexible package.

3. A flexible package comprising:

(a) a rectangular sheet of flexible polyethylene film material folded as a modified "M" and joined to itself so as to form a main compartment having a top wall and a bottom wall interconnected to one another by a multiplicity of side walls and a double walled ancillary compartment; and (b) a column of product units totally enclosed and sealed within said main compartment and adjacent at least one of said side walls; and (c) a relatively rigid, horizontal platform with a substantially planar upper surface supporting said product columns; and (d) a grid formed from vertically disposed, substantially planar panels separating said product columns; and (e) a horizontal tear strip perforated in the lower portion of said side walls in said main compartment, said tear strip defining an opening having a height less than twice the height of one of said product units and a length extending across at least one entire side wall of said main compartment; and (f) an ancillary compartment vertically extended from said main compartment; and (g) an opening at the top axial end of said ancillary compartment;

(h) said opening being closable by a drawstring inserted within said double walled ancillary compartment.

4. A flexible package according to claim 1 wherein said dispensing opening is created by removing a tear strip defined by said continuous line of weakness.

5. A flexible package according to claim 1, said package further comprising a grid of vertically disposed, substantially planar panels separating said columns of product units from one another.

6. A flexible package according to claim 1 or claim 2, wherein said means for repeatedly opening and closing said ancillary compartment comprises a drawstring circumscribing said opening at said top axial end of said ancillary compartment.

7. A flexible package according to claim 1 or claim 2, wherein said columns of product units rest on a substantially planar horizontal platform.

8. A flexible package according to claim 1, claim 2 or claim 3, wherein said dispensing opening extends horizontally along the entire horizontal length of the side wall of the main compartment in which said opening is located and vertically less than two times the height of one of said product units.

9. A flexible package according to claim 1, claim 2 or claim 3, wherein said flexible material comprising said package is selected from the group consisting of polyethylene, cellophane, saran, foil, and laminates thereof.

10. A flexible package according to claim 1, claim 2 or claim 3, said package further comprising means to retain said ancillary compartment in a collapsed condition when it is empty.

11. A flexible package according to claim 10, wherein said means to retain said ancillary compartment in a collapsed condition comprises pressure sensitive adhesive tape.

12. A flexible package according to claim 1, claim 2 or claim 3, wherein said product units are individually wrapped packages of coffee and wherein said ancillary compartment contains at least one ancillary material selected from the group consisting of coffee filters, creamer, sweetener, cups and stirrers.

* * * * *